US007429930B2

(12) United States Patent
Aoyanagi

(10) Patent No.: US 7,429,930 B2
(45) Date of Patent: Sep. 30, 2008

(54) PROJECTOR DEVICE WITH THEFT PREVENTION FUNCTION AND THEFT PREVENTING METHOD

(75) Inventor: Hisakazu Aoyanagi, Tokyo (JP)

(73) Assignee: NEC Viewtechnology, Ltd., Tokyo (JP)

( * ) Notice: Subject to any disclaimer, the term of this patent is extended or adjusted under 35 U.S.C. 154(b) by 180 days.

(21) Appl. No.: 11/337,472

(22) Filed: Jan. 24, 2006

(65) Prior Publication Data

US 2006/0164242 A1 Jul. 27, 2006

(30) Foreign Application Priority Data

Jan. 25, 2005 (JP) ..... 2005-016733

(51) Int. Cl.
*G08B 21/00* (2006.01)

(52) U.S. Cl. ..... 340/669; 340/539.13; 340/568.1; 340/686.1; 340/686.6

(58) Field of Classification Search ..... 340/669, 340/539.13, 568.1, 568.8, 686.1, 686.6, 539.15
See application file for complete search history.

(56) References Cited

U.S. PATENT DOCUMENTS

| | | | | |
|---|---|---|---|---|
| 5,825,283 | A * | 10/1998 | Camhi | 340/438 |
| 7,352,865 | B2 | 4/2008 | Gassho | |
| 2004/0119945 | A1 | 6/2004 | Nakamura et al. | |
| 2005/0039044 | A1 | 2/2005 | Gassho | |
| 2006/0116796 | A1 * | 6/2006 | Fossen et al. | 701/21 |

FOREIGN PATENT DOCUMENTS

| | | |
|---|---|---|
| JP | 07-160955 | 6/1995 |
| JP | 10-111991 | 4/1998 |
| JP | 2000-322663 | 11/2000 |
| JP | 3163242 | 2/2001 |
| JP | 2001-320776 | 11/2001 |
| JP | 2002-042272 | 2/2002 |
| JP | 2003-27530 | 1/2003 |
| JP | 2003-182526 | 7/2003 |
| JP | 2004-077967 | 3/2004 |
| JP | 2004-142528 | 5/2004 |
| JP | 2004-165755 | 6/2004 |
| JP | 2004-262375 | 9/2004 |
| WO | 03/107171 | 12/2003 |

* cited by examiner

*Primary Examiner*—George A Bugg
*Assistant Examiner*—Travis R Hunnings
(74) *Attorney, Agent, or Firm*—McGinn IP Law Group, PLLC

(57) ABSTRACT

X-direction double integrator 3 integrates twice an acceleration that is detected by x-direction acceleration sensor 1, estimating a traveled distance in an x direction. Y-direction double integrator 4 integrates twice an acceleration that is detected by y-direction acceleration sensor 2, estimating a traveled distance in a y direction. Detection boundary storage unit 5 stores a monitoring area. Detection boundary comparator 6 determines whether the projector device is positioned outside of the monitoring area or not based on the traveled distance in the x direction which is estimated by x-direction double integrator 3, the traveled distance in the y direction which is estimated by y-direction double integrator 4, and the monitoring area stored in detection boundary storage unit 5.

19 Claims, 8 Drawing Sheets

PROJECTOR DEVICE WITH THEFT PREVENTION FUNCTION AND THEFT PREVENTING METHOD

BACKGROUND OF THE INVENTION

1. Field of the Invention

The present invention relates to a projector device and a theft preventing method.

2. Description of the Related Art

In recent years, a growing number of projector devices have been stolen as they can be carried and are relatively expensive. Therefore, it is necessary to take some measures to prevent projectors from being stolen.

It has been customary to prevent a projector device from being stolen by either incorporating a theft prevention system into the projector device or attaching a theft prevention system to the projector device.

According to the former theft preventing scheme, the projector device is shut off by setting a password or using a PC card.

There are various types of the latter theft preventing systems. For example, Patent Document 1 (JP-A-10-111991) discloses a theft detector for detecting whether the projector device is moved or not with an acceleration sensor. The disclosed theft detector issues an alarm signal when the acceleration sensor detects a movement of the projector device.

Patent Document 2 (Japanese patent No. 3163242) reveals a method of and an apparatus for preventing a theft by estimating a distance that the projector device has moved with an acceleration sensor, and detecting a theft based on the total estimated distance.

According to the process of shutting off the projecting device by setting a password or using a PC card, however, the user needs to enter the password or insert the PC card each time the user is to use the projector device. Therefore, the process is tedious and time-consuming.

The theft detector disclosed in Patent Document 1 does not require the user to enter a password or insert a PC card because the acceleration sensor detects whether the projector device is moved or inclined.

However, since the projector device is often moved within a building or the like, theft detector disclosed in Patent Document 1 is possibly liable to detect a theft in error each time the projector device is moved. To avoid such a wrong theft decision, projector settings need to be changed or the theft detector needs to be removed from the projector device each time the projector device is to be moved. Consequently, the disclosed theft detector is cumbersome to use. The theft detector is not sufficiently effective for projector devices whose installed locations are often moved from place to place.

The theft preventing apparatus disclosed in Patent Document 2 estimates a distance that the projector device has moved with an acceleration sensor, and detects a theft based on the total estimated distance. The disclosed theft preventing apparatus does not require projector settings to be changed each time the projector device is to be moved. However, when the projector device changes its installed location, e.g., when the projector device is moved within one room, the projector device may be judged as being stolen based on the total distance that the projector has been moved.

SUMMARY OF THE INVENTION

It is an object of the present invention to provide a projector device with a theft prevention function which does not require the user to set a password for each use, and reduces a cumbersome process of theft detection and an erroneous action thereof based on whether the projector device is moved or not or based on the total distance that the projector device has moved and a theft preventing method.

To achieve the above object, a projector device with a theft prevention function according to the present invention has a position detecting unit, an area input unit, an area storage unit, and a detecting unit.

The position detecting unit detects a present position of the projector device.

The area input unit receives a monitoring area.

The area storage unit stores the monitoring area received by the area input unit.

The detecting unit detects whether the projector device is positioned outside the monitoring area or not based on the present position of the projector device detected by the position detecting unit and the monitoring area stored by the area storage unit.

With the above arrangement, regardless of the total distance that the projector has traveled, if the projector device is positioned within the monitoring area, then the projector device is not detected as being stolen. If the projector device is positioned outside the monitoring area, then the projector device is detected as being stolen. Consequently, insofar as the projector device is used within the monitoring area, the user is not required to take the trouble of the entering a password each time the projector device is used. It is also possible to avoid an erroneous theft detection based on the total distance that the projector has traveled.

Preferably, the monitoring area includes an initial position of the projector device, and the position detecting unit comprises an acceleration detecting unit and a traveled distance estimating unit.

The acceleration detecting unit detects accelerations of the projector device in two different directions.

The traveled distance estimating unit estimates traveled distances respectively in the two different directions of the projector from the initial position, based on the accelerations detected by the acceleration detecting unit.

It is thus possible to construct a projector device with a high theft prevention capability at a relatively low cost.

Preferably, the area input unit comprises a boundary input unit and a distance input unit.

The boundary input unit receives a boundary for specifying the monitoring area.

The distance input unit receives a distance as the radius of a circular area which serves as the monitoring area around the initial position at a center thereof.

Therefore, monitoring areas of complex shapes can relatively easily be set by reading graphic data, e.g., a floor plan, of a building or reading area data generated by a personal computer through a storage interface.

Preferably, the detecting unit comprises a boundary detecting unit, a linear distance estimating unit, and a distance detecting unit.

The boundary detecting unit detects whether the projector device is positioned outside the monitoring area or not based on the boundary of the monitoring area received by the boundary input unit and the present position of the projector device detected by the position detecting unit.

The linear distance estimating unit estimates a linear distance between the present position of the projector device detected by the position detecting unit and the initial position.

The distance detecting unit detects whether the projector device is positioned outside the monitoring area or not based on the distance received by the distance input unit and the linear distance estimated by the linear distance estimating unit.

Consequently, even if the user is not aware of the shape of a monitoring area, the user can set the monitoring area as a circular area, using the radius of the circular area with the initial position at the center. Accordingly, the user can easily set the monitoring area.

Preferably, the projector further comprises an alarm generating unit.

The alarm generating unit generates an alarm when the projector device is positioned outside the monitoring area.

The alarm generating unit makes it possible to indicate a theft to the surroundings of the projector device.

Preferably, the projector device further comprises a device function disabling unit.

The device function disabling unit stops image projecting operation of the projector device when the projector device is positioned outside the monitoring area.

When the projector device is positioned outside the monitoring area, the image projecting operation of the projector device is stopped. Therefore, use of the projector device that is stolen is limited. This arrangement is highly effective to prevent the projector device from being stolen.

Preferably, the projector device further comprises a battery including a chargeable battery and a power supply detecting unit.

The power supply detecting unit detects whether there is electric power supplied from a power cable or not.

The battery supplies electric power to the position detecting unit, the detecting unit, and the alarm generating unit if the power supply detecting unit detects when there is no electric power supplied from the power cable.

With the above arrangement, even if the projector device is not supplied with electric power from outside the projector device as when the power cable is disconnected from the projector device, the alarm generating unit can generate an alarm.

Preferably, the projector device further comprises a non-volatile memory, a battery power detecting unit, and a battery power turn-off detecting unit.

The battery power detecting unit detects a voltage drop of the battery.

The battery power turn-off detecting unit stores information representative of no supply of electric power in the non-volatile memory when the voltage drop of the battery is detected by the battery power detecting unit, and outputting the information stored in the non-volatile memory when the electric power resumes being supplied from the power cable.

Consequently, the user can be notified of no supply of electric power from the battery including the chargeable battery. The possibility that the theft prevention capability will be disabled due to a lack of supply of electric power, allowing the projector device to be stolen, is reduced.

According to the present invention, there is also provided a theft prevention method for being performed by a projector device, comprising:

area input process receiving a monitoring area;

area storage process for storing the monitoring area received in said area input process; and detecting process for detecting whether said projector device is positioned outside said monitoring area or not based on the present position of said projector device detected In said position detecting process and the monitoring area stored in said area storage process.

The above and other objects, features, and advantages of the present invention will become apparent from the following description with reference to the accompanying drawings which illustrate examples of the present invention.

DETAILED DESCRIPTION OF THE PREFERRED EMBODIMENTS

Figure 1:
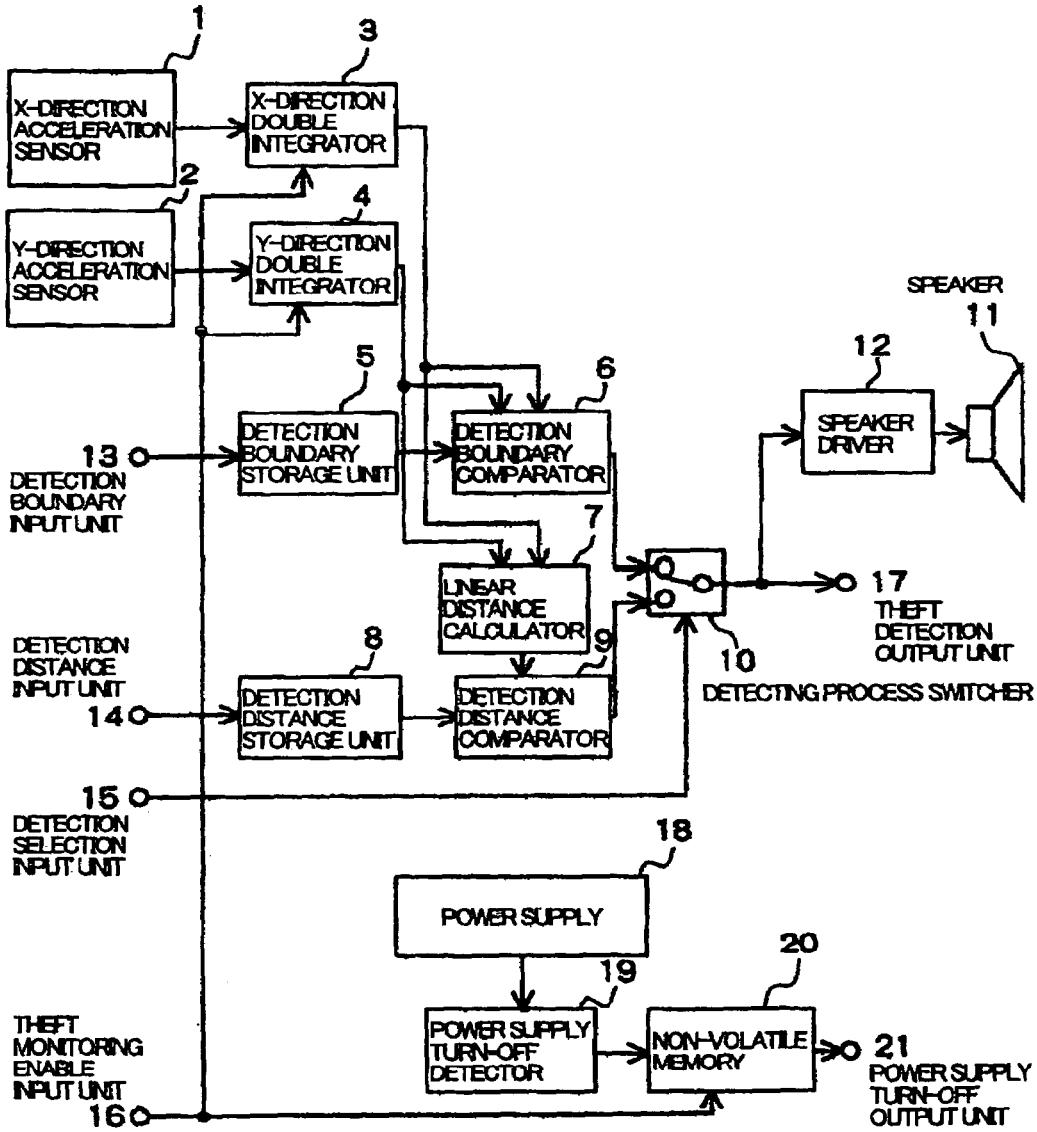
FIG. 1 is a block diagram of a theft detecting device incorporated in a projector device according to an embodiment of the present invention.

FIG. 1 shows in block form a projector device according to an embodiment of the present invention. Specifically, FIG. 1 shows in block form a theft detecting device incorporated in the projector device.

As shown in FIG. 1, the theft detecting device has X-direction acceleration sensor 1, y-direction acceleration sensor 2, x-direction double integrator 3, y-direction double integrator 4, detection boundary storage unit 5, detection boundary comparator 6, linear distance calculator 7, detection distance storage unit 8, detection distance comparator 9, detecting process switcher 10, speaker 11, speaker driver 12, detection boundary input unit 13, detection distance input unit 14, detection selection input unit 15, theft monitoring enable input unit 16, theft detection output unit 17, power supply 18, power supply turn-off detector 19, non-volatile memory 20, and power supply turn-off output unit 21.

When a signal supplied from theft monitoring enable input unit 16 represents a monitoring state, the values of signals from x-direction double integrator 3 and y-direction double integrator 4 are initialized to 0. Non-volatile memory 20 is initialized.

When the projector device is moved, x-direction acceleration sensor 1 and y-direction acceleration sensor 2 detect respective accelerations of the projector device in two different horizontal directions, i.e., x and y directions.

X-direction double integrator 3 integrates twice the acceleration that is detected by x-direction acceleration sensor 1. Y-direction double integrator 4 integrates twice the acceleration that is detected by y-direction acceleration sensor 2.

When an acceleration is integrated twice, a traveled distance is calculated. Therefore, x-direction double integrator 3 and y-direction double integrator 4 estimate respective traveled distances in the x and y directions of the projector device from the position thereof (theft monitoring start position 31 in FIGS. 3*a* and 3*b*) at the time a theft monitoring process is started, i.e., at the time a signal from theft monitoring enable input unit 16 represents a monitoring state.

The distances estimated respectively by x-direction double integrator 3 and y-direction double integrator 4 are distances from theft monitoring start position 31. Therefore, double integrals produced by x-direction double integrator 3 and y-direction double integrator 4 represent x-direction and y-direction components of the present position of the projector device.

Figure 2:
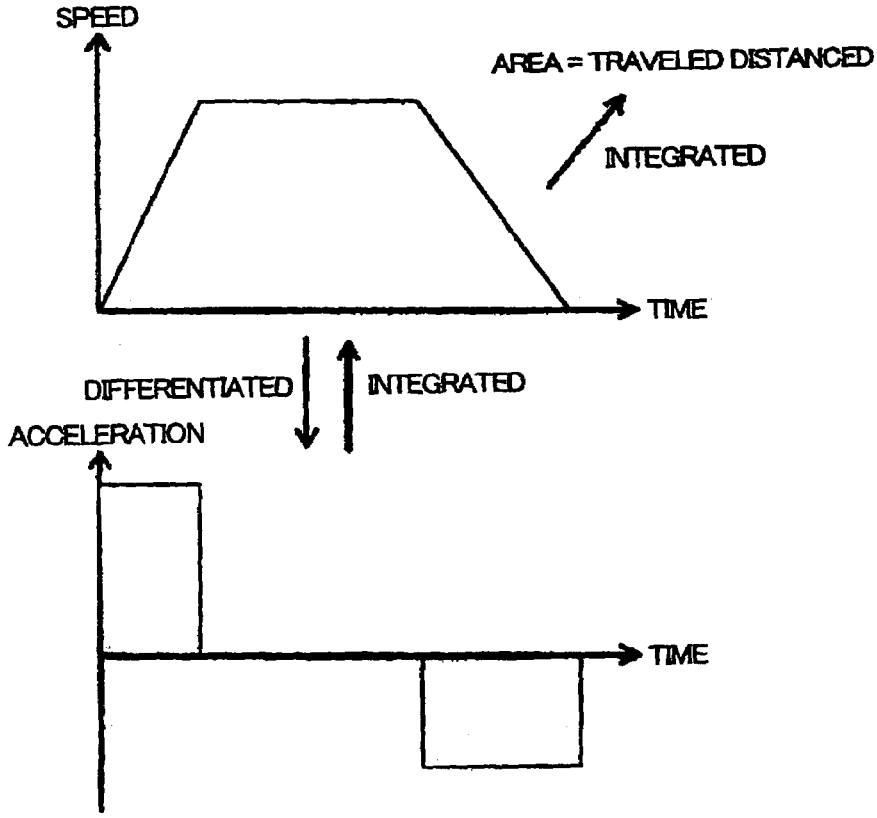
FIG. 2 is a diagram showing the principles of a process of detecting a traveled distance with an accelerator sensor.

FIG. 2 shows the principles of a process of detecting a traveled distance by integrating an acceleration twice.

Referring back to FIG. 1, detection boundary input unit 13 and detection distance input unit 14 receive information specifying a monitoring area.

The monitoring area is such an area that when the projector device is located within the area, the projector device is not detected as being stolen, and when the projector device is located outside the area, the projector device is detected as being stolen, The monitoring area is a two-dimensional area.

Detection boundary input unit 13 comprises a storage interface, for example, and receives a detection boundary which specifies the monitoring area.

Detection boundary storage unit 5 stores the detection boundary received by detection boundary input unit 13.

Detection boundary comparator 6 determines whether the present position of the projector device, which is detected based on theft monitoring start position 31, the traveled distance in the x direction that is calculated by x-direction double integrator 3, and the traveled distance in the y direction that is calculated by y-direction double integrator 4, is located outside the area specified by the detection boundary that is stored in detection boundary storage unit 5 or not.

If the present position of the projector device is located outside the area specified by the detection boundary that is stored in detection boundary storage unit 5, then detection boundary comparator 6 outputs a signal representing a detected theft to detecting process switcher 10.

Figure 3A:
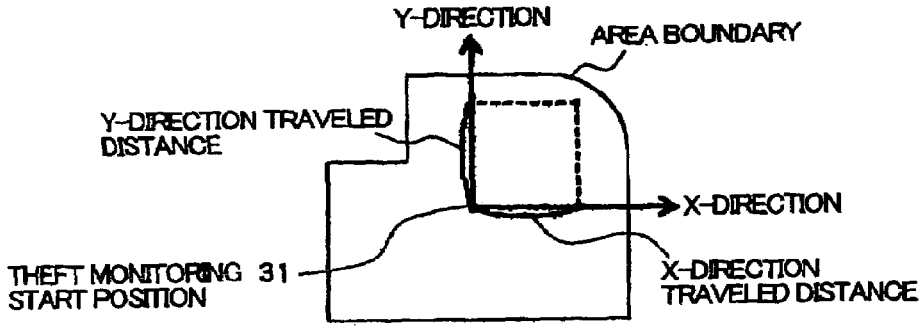
FIG. 3*a* is a schematic diagram showing the relationship between a detection boundary and a traveled distance.

FIG. 3*a* schematically shows the detection boundary.

Theft monitoring start position 31 represents the position of the projector device at the time the theft monitoring process is started. Stated otherwise, theft monitoring start position 31 represents a position at the time the signal supplied from theft monitoring enable input unit 16 represents the monitoring state and the integrals produced by x-direction double integrator 3 and y-direction double integrator 4 are initialized to 0.

The detection boundary is defined with respect to theft monitoring start position 31 and the x and y directions.

Detection boundary comparator 6 determines whether the present position of the projector device, which is calculated from theft monitoring start position 31, the traveled distance in the x direction that is calculated by x-direction double integrator 3, and the traveled distance in the y direction that is calculated by y-direction double integrator 4, is located outside the area specified by the detection boundary or not.

Referring back to FIG. 1, detection distance input unit 14 receives a detection distance representing the radius of a circular area that is specified as a monitoring area around theft monitoring start position 31 at the center.

Linear distance calculator 7 estimates a linear distance between the present position of the projector device and the position of the projector device at the time the theft monitoring process is started, i.e., the position of the projector device at the time the signal supplied from theft monitoring enable input unit 16 represents the monitoring state.

Detection distance storage unit 8 stores the detection distance received by detection distance input unit 14.

Detection distance comparator 9 compares the linear distance calculated by linear distance calculator 7 and the detection distance stored in detection distance storage unit 8 with each other to determine whether the linear distance is equal to or greater than the detection distance or not. Stated otherwise, detection distance comparator 9 determines whether the present position of the projector device is located outside the area specified by the detection distance stored in detection distance storage unit 8 or not.

If the present position of the projector device is located outside the area specified by the detection distance stored in detection distance storage unit 8, then detection distance comparator 9 outputs a signal representing a detected theft to detecting process switcher 10.

Figure 3B:
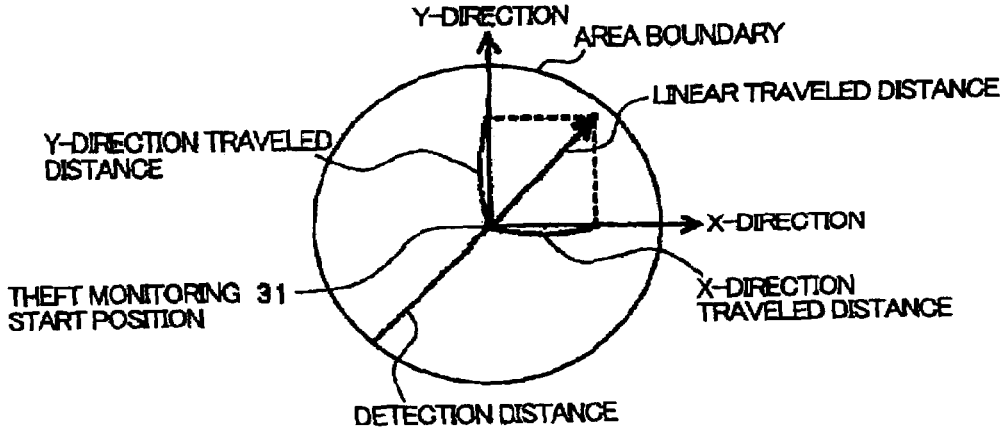
FIG. 3*b* is a schematic diagram showing the relationship between a detection distance and a traveled distance.

FIG. 3*b* schematically shows the detection distance.

The detection distance is defined with respect to theft monitoring start position 31.

Detection distance comparator 9 determines whether the present position of the projector device is located outside a circular area having a radius represented by the detection distance stored in detection distance storage unit 8 or not.

Referring back to FIG. 1, detection selection input unit 15 receives detection judgment information indicative of which one of the detected signals from detection boundary comparator 6 and detection distance comparator 9 is to be used for theft detection.

Detecting process switcher 10 selects either one of the detected signals from detection boundary comparator 6 and detection distance comparator 9 for theft detection based on the detection judgment information received by detection selection input unit 15.

When detecting process switcher 10 receives the detected signal from detection boundary comparator 6 or the detected signal from detection distance comparator 9, detecting process switcher 10 outputs the received detected signal to theft detection output unit 17 and speaker driver 12.

Speaker driver 12 energizes speaker 11 to produce an alarm sound when it receives the detected signal from detecting process switcher 10.

Usually, when the projector device is stolen, the projector device is moved after its power cable is disconnected therefrom.

Therefore, when the power cable is connected to the projector device and the theft detecting device can be supplied with electric power from outside the projector device, the theft detecting device should preferably be supplied with electric power from outside the projector device. When the power cable is disconnected from the projector device and the theft detecting device cannot be supplied with electric power from outside the projector device, the theft detecting device should preferably be supplied with electric power from an internal power supply of the projector device.

Power supply 18, power supply turn-off detector 19, non-volatile memory 20, and power supply turn-off output unit 21 are provided on the assumption that the power cable is disconnected from the projector device and the projector device is moved.

Power supply 18 comprises a battery including a chargeable battery.

If the battery is a chargeable battery, then it is charged when the power cable is connected to the projector device.

When the theft detecting device cannot be supplied with electric power from outside the projector device as when the power cable is disconnected from the projector device, the theft detecting device is supplied with electric power from power supply 18.

Power supply turn-off detector 19 monitors power supply 18 at all times.

Power supply turn-off detector 19 determines whether the voltage of power supply 18 has dropped or not.

When the power cable is connected to the projector device after the voltage of power supply 18 has dropped and the theft detecting device has been disabled, power supply turn-off detector 19 determines that the power supply of the theft detecting device is turned off in the theft monitoring process.

When the voltage of power supply 18 drops, power supply turn-off detector 19 outputs a power supply turn-off signal indicating that the power supply is turned off to non-volatile memory 20 before the voltage of power supply 18 reaches a level low enough to disable the theft detecting device.

Non-volatile memory 20 comprises an electrically rewritable non-volatile memory such as a flash memory or the like.

When non-volatile memory 20 receives the power supply turn-off signal from power supply turn-off detector 19, non-volatile memory 20 stores the received power supply turn-off signal.

When the power cable is connected to the projector device after non-volatile memory 20 has stored the power supply turn-off signal, non-volatile memory 20 outputs the stored power supply turn-off signal to power supply turn-off output unit 21.

Figure 4:
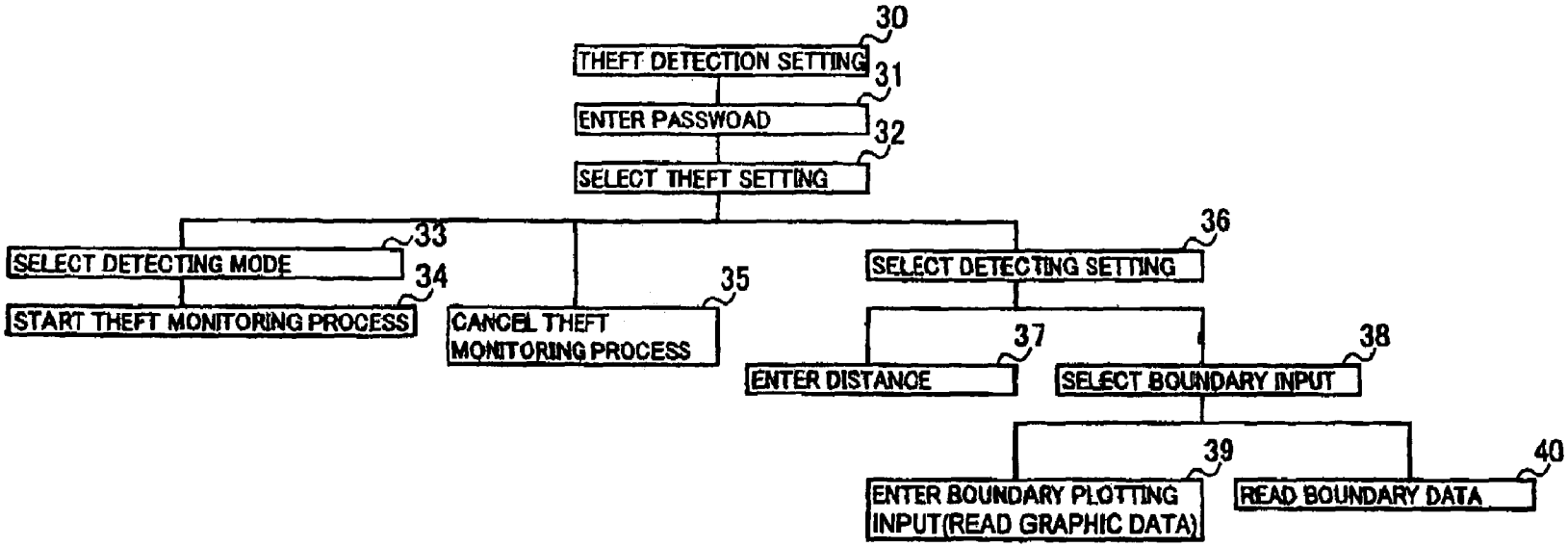
FIG. 4 is a flowchart of an operation sequence for setting a theft detecting process.

A process of setting the theft detecting process will be described below with reference to FIG. 4. FIG. 4 is a flowchart of an operation sequence for setting a theft detecting process.

In step 30, the process of setting the theft detecting process is started. Then, step 31 is executed.

In step 31, the user is prompted to enter a password. The theft detecting process can be set by the administrator who knows the password. If it is confirmed that the entered password is correct, then step 32 is executed.

In step 32, the administrator, i.e., the user, is prompted to select one of items relative to the theft detecting process, i.e., the start of a theft monitoring process, the cancellation of a theft monitoring process, and the setting of a detection area.

If the start of a theft monitoring process is selected, then step 33 is executed. If the cancellation of a theft monitoring process is selected, then step 35 is executed. If the setting of a detection area is selected, then step 36 is executed.

In step 33, the user is prompted to select either one of an area boundary setting for using an output signal from detection boundary comparator 6 as a monitoring area and a distance setting for using an output signal from detection distance comparator 9 as a monitoring area. When detection selection input unit 15 receives the selected setting, it operates detecting process switcher 10. Thereafter, step 34 is executed.

In step 34, a signal supplied from theft monitoring enable input unit 16 represents a monitoring state. Thereafter, the theft monitoring process begins.

In step 35, a signal supplied from theft monitoring enable input unit 16 represents a non-monitoring state. Thereafter, the theft monitoring process ends.

In step 36, the user is prompted to select either one of a distance setting and a boundary setting. If a distance setting is selected, then step 37 is executed. If a boundary setting is selected, then step 38 is executed.

In step 37, the user is prompted to enter a detection distance. When the user enters a detection distance, detection distance input unit 14 receives the entered detection distance. Thereafter, detection distance storage unit 8 stores the detection distance.

In step 38, the user is prompted to select either one of a boundary data input and a boundary plotting input. If a boundary plotting input is selected, then step 39 is executed. If a boundary data input is selected, then step 40 is executed.

In step 39, the user is prompted to enter a boundary plotting input. When the user enters a detection boundary with the boundary plotting input, detection boundary input unit 13 receives the entered detection boundary. Thereafter, detection boundary storage unit 5 stores the detection boundary.

The boundary plotting input may be applied according to two processes. According to one of the two processes, the detection boundary is plotted using a plotting function of the projector device. According to the other process, graphic data of a site or a building is read.

In the former process, the user plots the detection boundary over an image that is being projected by the projector device, using a pointing device, e.g., a USB mouse connected to the projector device, or a remote controller direction key.

Figure 5:
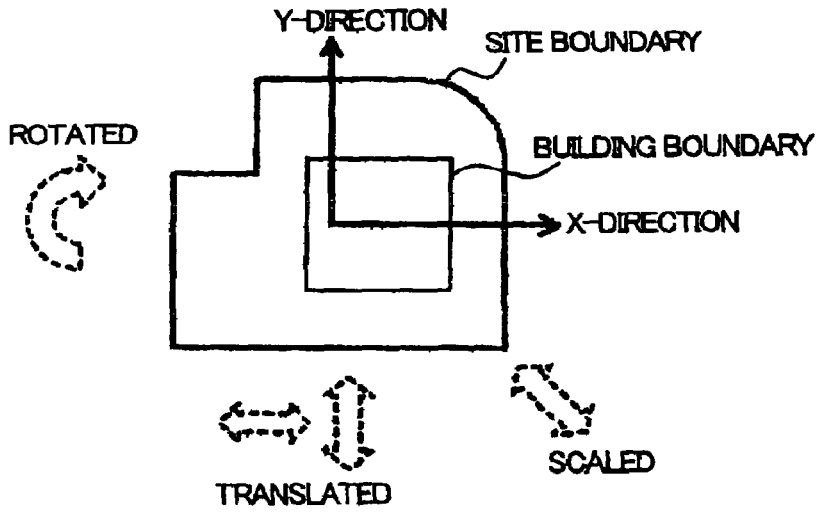
FIG. 5 is a schematic diagram showing a boundary setting using graphic data.

In the latter process, the projector device reads graphic data of a site or a building as shown in FIG. 5.

Thereafter, the user turns the projector device or turns the graphic data to bring the directions of x-direction acceleration sensor 1 and y-direction acceleration sensor 2 into alignment with the directions of the read graphic data.

Then, the user translates the graphic data to bring the present position of the projector into alignment with the position of the projector on the graphic data.

Furthermore, the user scales the graphic data to set the scales in the x and y directions to lines corresponding to the detection boundary on the graphic data.

The above settings are entered using the pointing device, e.g., the USB mouse connected to the projector device, or the remote controller direction key.

In step 40, the detection boundary, which has been generated by a personal computer or the like, is read through an interface with a storage device, e.g., a USB memory or a PC card, of the projector device. The detection boundary is set in this manner. When the detection boundary is set, detection boundary input unit 13 receives the detection boundary, and thereafter detection boundary storage unit 5 stores the detection boundary, as with step 39.

Operation of the theft detecting device in the theft monitoring process will be described below with reference to FIG. 6.

Figure 6:
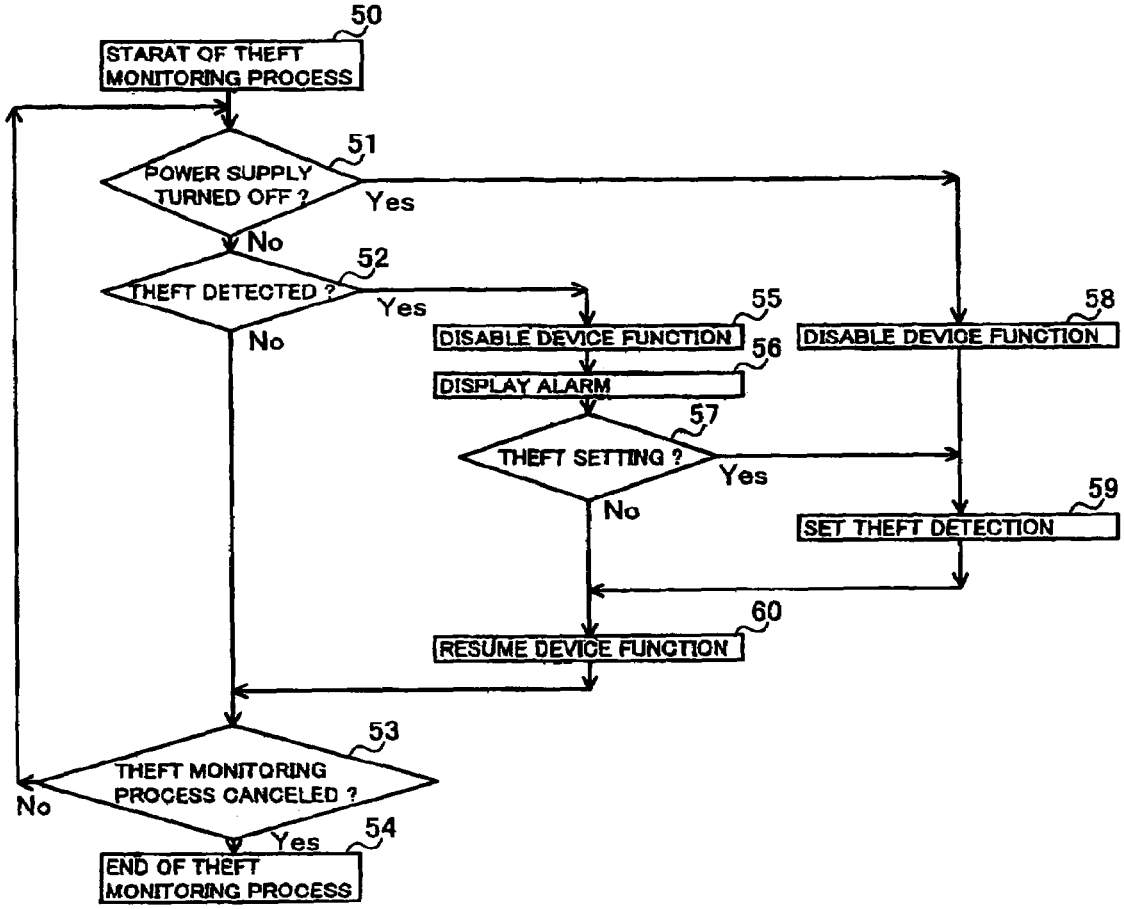
FIG. 6 is a flowchart of an operation sequence for performing a theft monitoring process.

FIG. 6 is a flowchart of an operation sequence of the theft detecting device for performing the theft monitoring process.

In step 50, the theft monitoring process is started, monitoring power supply turn-off output unit 21 and theft detection output unit 17 with a theft monitoring loop. Thereafter, step 51 is executed.

In step 51, based on the output signal from power supply turn-off output unit 21, it is determined whether power supply 18 is turned off or not. If it is judged that power supply 18 is turned off, then step 58 is executed. If it is judged that power supply 18 is not turned off, then step 52 is executed.

In step 52, based on the output signal from theft detection output unit 17, it is determined whether the projector device is stolen or not. Stated otherwise, it is determined whether the present position of the projector device is located outside the monitoring area specified by detection boundary storage unit 5 or linear distance calculator 7 or not. If it is judged that the projector device is stolen, then step 55 is executed. If it is judged that the projector device is not stolen, then step 53 is executed.

In step 53, it is determined whether the theft monitoring process is canceled or not. If it is judged that the theft monitoring process is canceled or, then step 54 is executed. If it is judged that the theft monitoring process is not canceled, then step 51 is executed.

In step 54, the signal supplied from theft monitoring enable input unit 16 represents the non-monitoring state. Thereafter, the theft monitoring process is put to an end.

In step 55, the image projecting operation of the projector device is temporarily stopped. Thereafter, step 56 is executed.

In step 56, the projector device displays an alarm message in its projected image, and speaker 11 produces an alarm sound. Thereafter, step 57 is executed.

In step 57, the user is prompted to select whether a theft setting is to be made or not. If a theft setting is made, then step 59 is executed. If a theft setting is not made, then step 60 is executed.

In step 58, the image projecting operation of the projector device is temporarily stopped. Thereafter, step 59 is executed.

In step 59, step 31 shown in FIG. 4 is executed. Stated otherwise, the user is prompted to enter the password. After the operation sequence shown in FIG. 4 is ended, step 60 is executed.

In step 60, the interrupted image projecting operation of the projector device is resumed. Thereafter, step 53 is executed.

If the theft monitoring process is canceled in step 53 after it is confirmed that the password entered in step 59 is correct, then step 60 is executed. Thereafter, the cancellation of the theft monitoring process is detected in step 53, and the theft monitoring process is ended in step 54.

If the password entered in step 59 is incorrect or if the theft monitoring process is not canceled in step 53 though the entered password is correct, then step 60 is executed. Stated otherwise, the image projecting operation of the projector device is resumed. Immediately thereafter, however, it is judged that power supply 18 is turned off in step 51 or it is judged that the projector device is stolen in step 52. Then, the image projecting operation of the projector device is temporarily stopped again in step 55 or step 58. Therefore, the use of the projector device is limited.

If no theft setting is made in step 57, step 60 is executed. Stated otherwise, the image projecting operation of the projector device is resumed.

At this time, if the projector device moves into the area specified by the detection boundary or the detection distance, then the alarm sound produced by speaker 11 is ceased.

When the alarm sound produced by speaker 11 is ceased, the interrupted image projecting operation of the projector device is resumed in step 60, and the theft monitoring loop is resumed.

If the projector device does not move into the area specified by the detection boundary or the detection distance, then the image projecting operation of the projector device is resumed in step 60. Immediately thereafter, however, it is judged that the projector device is stolen in step 52. Thereafter, the image projecting operation of the projector device is temporarily stopped in step 55, and the alarm sound is generated in step 56. Therefore, the use of the projector device is limited.

A data generating software application which is executed by a personal computer for generating data in step 40 shown in FIG. 4 will be described below with reference to FIG. 7.

Figure 7:
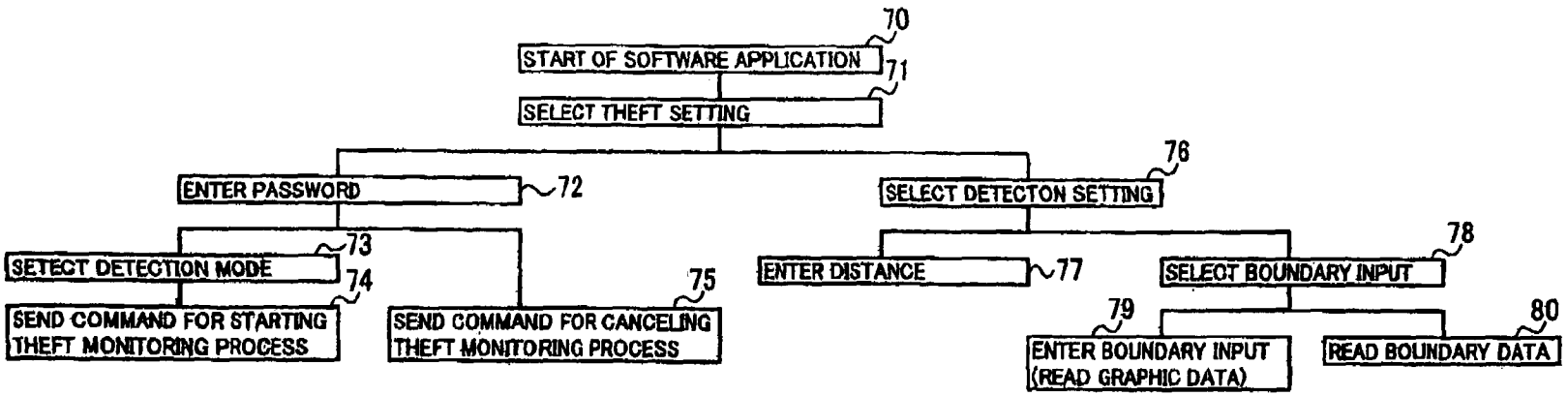
FIG. 7 is a flowchart of an operation sequence of a data generating software application executed by a personal computer for generating boundary data.

FIG. 7 is a flowchart of such a data generating software application. The data generating software application is capable of, in addition to generating data, sending a command for starting the theft monitoring process or a command for canceling the theft monitoring process to the projector device, thereby starting the theft monitoring process or canceling the theft monitoring process.

In step 70, the data generating software application begins to be executed. Then, step 71 is executed.

In step 71, the user, is prompted to select one of items relative to the theft detecting process, i.e., the start of a theft monitoring process, the cancellation of a theft monitoring process, and the setting of a detection area. If the start of a theft monitoring process or the cancellation of a theft monitoring process is selected, then step 72 is executed. If the setting of a detection area is selected then, step 76 is executed.

In step 76, the user is prompted to select either one of a distance setting and a boundary setting. If a distance setting is selected, then step 77 is executed. If a boundary setting is selected, then step 78 is executed.

In step 77, the user is prompted to enter a detection distance. When the user enters a detection distance, detection distance input unit 14 receives the entered detection distance. Thereafter, detection distance storage unit 8 stores the detection distance.

In step 78, the user is prompted to select either one of a boundary data input and a boundary plotting input. If a boundary plotting input is selected, then step 79 is executed. If a boundary data input is selected, then step 80 is executed.

In step 79, a detection boundary is entered or graphic data of a site or a building is read.

In step 80, boundary data is written through a storage interface of the projector device into a storage device, e.g., a USB memory or a PC card, of the projector device.

In step 72, the user is prompted to enter a password. When the user enters the password, the user is prompted to select either one of the start of the theft monitoring process and the cancellation of the theft monitoring process. If the user selects the start of the theft monitoring process, then step 73 is executed. If the user selects the cancellation of the theft monitoring process, then step 75 is executed.

In step 73, the user is prompted to select either one of a distance setting and a boundary setting. After the user selects either a distance setting or a boundary setting, step 74 is executed.

In step 74, a command for a detection mode is sent to the projector device. Furthermore, commands for the detection distance entered in step 77 and the detection boundary entered in step 79 or step 80 are sent to the projector device.

In response to the commands, the projector device determines whether the password entered in step 72 agrees with the password that is preset in the projector device or not.

If the former agrees with the latter, then detection selection input unit 15 receives the command for the detection mode, shifting detecting process switcher 10.

For detecting the boundary, detection boundary input unit 13 receives the detection boundary, and detection boundary storage unit 5 stores the detection boundary. For detecting the distance, detection distance input unit 14 receives the detection distance, and detection distance storage unit 8 stored the detection distance.

The signal supplied from theft monitoring enable input unit 16 represents the monitoring state. Thereafter, the theft monitoring process is started.

For canceling the theft monitoring process, the user is prompted to enter the password in step 72. If the user enters the password, then step 75 is executed.

In step 75, a command for canceling the theft monitoring process is sent to the projector device. In response to the command, the projector device determines whether the password entered in step 72 agrees with the password that is preset in the projector device or not. If the former agrees with the latter, then signal supplied from theft monitoring enable input unit 16 represents the non-monitoring state. Thereafter, the theft monitoring process is put to an end.

According to the present embodiment, x-direction acceleration sensor 1 and y-direction acceleration sensor 2 detect respective accelerations in two different horizontal directions, i.e., x and y directions.

X-direction double integrator 3 integrates twice the acceleration that is detected by x-direction acceleration sensor 1. Y-direction double integrator 4 integrates twice the acceleration that is detected by y-direction acceleration sensor 2. Stated otherwise, x-direction double integrator 3 estimates a traveled distance in the x direction of the projector device from theft monitoring start position 31, and y-direction double integrator 4 estimates a traveled distance in the y direction of the projector device from theft monitoring start position 31.

Detection boundary storage unit 5 stores the information that specifies the area received by detection boundary input unit 13. Detection distance storage unit 8 stores the information that specifies the area specified by detection distance input unit 14. Detection boundary comparator 6 determines whether the projector device is positioned outside the area specified by the information stored in detection boundary storage unit 5 or not, based on the position of the projector device and the area-specifying information stored in detection boundary storage unit 5. Detection distance comparator 9 determines whether the projector device is positioned outside the area specified by the information stored in detection distance storage unit 8 or not, based on the position of the projector device and the area-specifying information stored in detection distance storage unit 8.

Regardless of the total distance that the projector has traveled, if the projector device is positioned within the monitoring area, then the projector device is not detected as being stolen. If the projector device is positioned outside the monitoring area, then the projector device is detected as being stolen. Consequently, insofar as the projector device is used within the monitoring area, the user is not required to take the trouble of the entering the password each time the projector device is used. It is also possible to avoid an erroneous theft detection based on the total distance that the projector has traveled.

According to the present embodiment, detection boundary input unit 13 receives a detection boundary which specifies the monitoring area.

In this case, monitoring areas of complex shapes may relatively easily be set by reading graphic data, e.g., a floor plan, of a building or reading area data generated by a personal computer through a storage interface.

According to the present embodiment, detection distance input unit 14 receives a detection distance representing the radius of a circular area that is specified as a monitoring area around theft monitoring start position 31 at the center.

In this case, even it the user is not aware of the shape of a monitoring area, the user can set the monitoring area as a circular area by making the projector device read a detection distance representing the radius of a circle with the theft monitoring start position 31 at the center. Accordingly, the user can easily set the monitoring area.

According to the present embodiment, when the projector device is positioned outside the area that is specified by the information stored in detection boundary storage unit 5 or detection distance storage unit 8, the speaker driver 12 energizes the speaker 11 to generate an alarm sound.

In this case, it is possible to indicate the theft to the surroundings of the projector device.

According to the present embodiment, when the projector device is positioned outside the area that is specified by the information stored in detection boundary storage unit 5 or detection distance storage unit 8, theft detection output unit 17 outputs a signal representative of the detected theft, stopping the image projecting operation of the projector device.

Consequently, when the projector device is positioned outside the area that is specified by the information stored In detection boundary storage unit 5 or detection distance storage unit 8, the image projecting operation of the projector device is stopped. Therefore, the possibility that the stolen projector device will be used is reduced. This arrangement is highly effective to prevent the projector device from being stolen.

According to the present embodiment, even when there is no electric power supplied from the power cable, power supply 18, which comprises a battery including a chargeable battery, supplies electric power to enable detection boundary comparator 6 and detection distance comparator 9 to detect when the projector device is positioned outside the area specified by the information stored in detection boundary storage unit 5 or the detection distance storage unit 8 or not. Speaker driver 12 also energizes speaker 11 to generate an alarm sound.

Consequently, even when the power cable is disconnected from the projector device and the theft detecting device cannot be supplied with electric power from outside the projector device, it is possible to produce an alarm signal.

According to the present embodiment, power supply turn-off detector 19 detects a voltage drop of power supply 18. When the voltage of power supply 18 drops, power supply turn-off detector 19 stores information indicative of no supply of electric power in non-volatile memory 20. When the supply of electric power from the power cable is resumed, power supply turn-off output unit 21 outputs the information stored in non-volatile memory 20.

Consequently, the user can be notified of no supply of electric power from the power supply. The possibility that the theft prevention capability will be disabled due to a lack of supply of electric power, allowing the projector device to be stolen, is reduced.

The above embodiment has been illustrated by way of example only. The present invention is not limited to the illustrated details of the above embodiment, but may be embodied otherwise.

Figure 8:
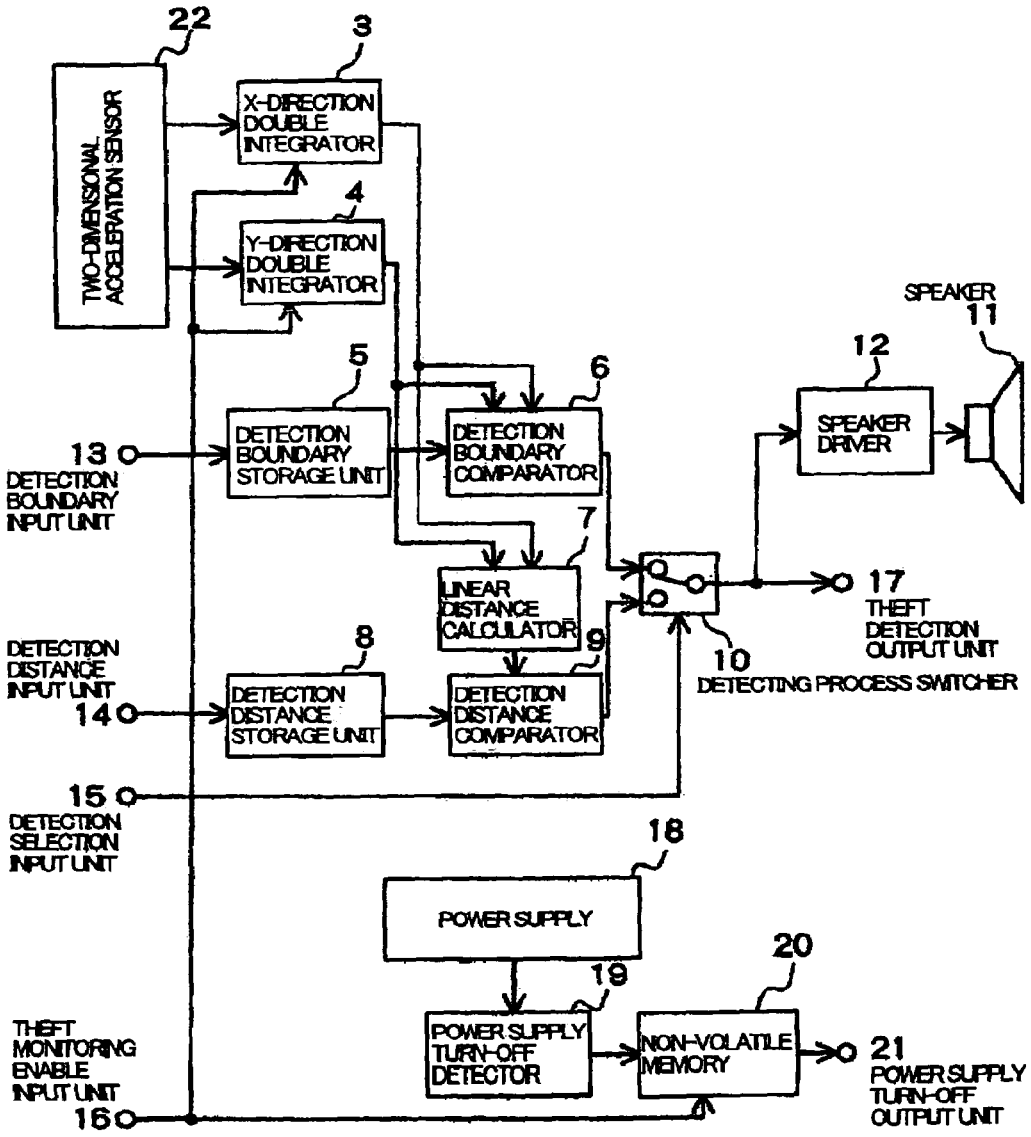
FIG. 8 is a block diagram of a theft detecting device incorporated in a projector device according to another embodiment of the present invention.

For example, a projector device shown in FIG. 8 may be employed instead of the projector device shown in FIG. 1.

In FIG. 1, the projector device has two acceleration sensors, i.e., x-direction acceleration sensor 1 and y-direction acceleration sensor 2. In FIG. 8, however, the projector device has a single two-dimensional acceleration sensor capable of detecting accelerations in two different horizontal directions.

While preferred embodiments of the present invention have been described using specific terms, such description is for illustrative purposes only, and it is to be understood that changes and variations may be made without departing from the spirit or scope of the following claims.

What is claimed is:

1. A projector device with a theft prevention function, comprising:

a position detecting unit that estimates a traveled distance of said projector device, determines if the estimated distance is greater than a predetermined distance, and detects a present position of the projector device;

an area input unit that receives a monitoring area;

an area storage unit that stores the monitoring area received by said area input unit;

a detecting unit that detects whether said projector device is positioned outside said monitoring area based on the present position of said projector device detected by said position detecting unit and the monitoring area stored by said area storage unit; and a detecting process switcher that determines if the position detecting unit has determined if the estimated travel distance is greater than the predetermined detection distance and if the detected present position of the projector is outside of the monitoring area, the detecting process switcher determines that the projector device is stolen, wherein when the estimated travel distance is greater than the predetermined detection distance and the detected present position of the projector is within the monitoring area, the detecting process switcher determines that the projector is not stolen.

2. A projector device according to claim 1, wherein said monitoring area includes an initial position of said projector device; and wherein said position detecting unit comprises:

an acceleration detecting unit that detects accelerations of said projector device in two different directions; and a traveled distance estimating unit that estimates traveled distances respectively in said two different directions of said projector from said initial position, based on the accelerations detected by said acceleration detecting unit.

3. A projector device according to claim 1, wherein said area input unit comprises:

a boundary input unit that receives a boundary for specifying said monitoring area; and a distance input unit that receives a distance as the radius of a circular area which serves as said monitoring area around said initial position at a center thereof.

4. A projector device according to claim 3, wherein said detecting unit comprises:

a boundary detecting unit that detects whether said projector device is positioned outside said monitoring area based on the boundary of the monitoring area received by said boundary input unit and the present position of said projector device detected by said position detecting unit;

a linear distance estimating unit that estimates a linear distance between the present position of said projector device detected by said position detecting unit and said initial a distance detecting unit that detects whether said projector device is positioned outside said monitoring area based on the distance received by said distance input unit and the linear distance estimated by said linear distance estimating unit.

5. A projector device according to claim 1, further comprising:

an alarm generating unit that generates an alarm when the detecting process switcher has determined the projector has been stolen.

6. A projector device according to claim 1, further comprising:

a device function disabling unit that stops image projecting operation of said projector device when the detecting process switcher has determined the projector has been stolen.

7. A projector device according to claim 5, further comprising:

a battery including a chargeable battery; and a power supply detecting unit that detects whether there is electric power supplied from a power cable;

wherein said battery supplies electric power to said position detecting unit, said detecting unit, and said alarm generating unit if said power supply detecting unit detects there is no electric power supplied from the power cable.

8. A projector device according to claim 6, further comprising:

a battery including a chargeable battery; and a power supply detecting unit that detects whether there is electric power supplied from a power cable;

wherein said battery supplies electric power to said position detecting unit, said detecting unit, and said alarm generating unit if said power supply detecting unit detects there is no electric power supplied from the power cable.

9. A projector device according to claim 7, further comprising:

a non-volatile memory;

a battery power detecting unit that detects a voltage drop of said battery; and a battery power turn-off detecting unit that stores information representative of no supply of electric power in said non-volatile memory when the voltage drop of said battery is detected by said battery power detecting unit, and outputting the information stored in said non-volatile memory when the electric power resumes being supplied from the power cable.

10. A projector device with a theft prevention function, comprising:

position detecting means for detecting a present position of the projector device;

area input means for receiving a monitoring area;

area storage means for storing the monitoring area received by said area input means;

detecting means for detecting whether said projector device is positioned outside said monitoring area based on the present position of said projector device detected by said position detecting means and the monitoring area stored by said area storage means;

a detecting process switcher that determines if the detecting means has determined if the projector device is outside the monitoring area and if the detected present position of the projector is outside of the monitoring area, the detecting process switcher recognizes that the projector is stolen, wherein when the detected present position of the projector is within the monitoring area, the detecting process switcher determines that the projector is not stolen.

11. A theft prevention method for being performed by a projector device, comprising:

detecting a present position of the projector device;

receiving a monitoring area;

storing the monitoring area received in said receiving of the monitoring area;

detecting whether said projector device is positioned outside said monitoring area based on the present position of said projector device detected in said detecting of the present position of the projector and the monitoring area stored in said storing of the monitoring area;

detecting whether there is electric power supplied from a power cable; and supplying electric power from a battery of the projector device to said position detecting unit, said detecting unit, and said alarm generating unit if said detecting of the electric power detects there is no electric power supplied from the power cable;

detecting a voltage drop of said battery; and storing information representative of no supply of electric power in non-volatile memory when the voltage drop of said battery is detected in said detecting of the voltage drop, and outputting the information stored in said non-volatile memory when the electric power resumes being supplied from the power cable.

12. A theft prevention method according to claim 11, wherein said monitoring area includes an initial position of said projector device; and wherein said detecting of the present position of the projector device comprises:

detecting accelerations of said projector device in two different directions; and estimating traveled distances respectively in said two different directions of said projector from said initial position, based on the accelerations detected in said detecting of the accelerations of the projector device.

13. A theft prevention method according to claim 11, wherein said receiving of the monitoring area comprises:

receiving a boundary for specifying said monitoring area; and receiving a distance as the radius of a circular area which serves as said monitoring area around said initial position at a center thereof.

14. A theft prevention method according to claim 13, wherein said detecting of whether the projector device is positioned outside the monitoring area comprises:

detecting whether said projector device is positioned outside said monitoring area based on the boundary of the monitoring area received in said receiving of the boundary and the present position of said projector device detected in said detecting of the present position of the projector;

estimating a linear distance between the present position of said projector device detected in said detecting of the present position of the projector and said initial position; and detecting whether said projector device is positioned outside said monitoring area based on the distance received in said receiving of the distance and the linear distance estimated is said estimating of the linear distance.

15. A theft prevention method according to claim 11, further comprising:

generating an alarm when said projector device is positioned outside said monitoring area.

16. A theft prevention method according to claim 11, further comprising:

stopping image projecting operation of said projector device when said projector device is positioned outside said monitoring area.

17. A theft prevention method according to claim 15, wherein said projector device includes a battery including a chargeable battery, a position detecting unit that executes said detecting of the present position of the projector, a detecting unit that executes said detecting of whether the projector device is positioned outside the monitoring area, and an alarm generating unit that executes said generating of the alarm, said theft prevention method further comprising:

detecting whether there is electric power supplied from a power cable; and supplying electric power from said battery to said position detecting unit, said detecting unit, and said alarm generating unit if said detecting whether there is electric power detects there is no electric power supplied from the power cable.

18. A theft prevention method according to claim 16, wherein said projector device includes a battery including a chargeable battery, a position detecting unit that executes said detecting of the present position of the projector, a detecting unit that executes said detecting of whether the projector device is positioned outside the monitoring area, and an alarm generating unit that executes said generating of the alarm, said theft prevention method further comprising:

detecting whether there is electric power supplied from a power cable; and supplying electric power from said battery to said position detecting unit, said detecting unit, and said alarm generating unit if said detecting whether there is electric power supplied from the power cable detects there is no electric power supplied from the power cable.

19. The projector device of claim 10, further comprising a theft detection unit configured to require an input of a password if the detected present position of the projector device is outside of the monitoring area.

* * * * *